US005639213A

United States Patent [19]

Chi

[11] Patent Number: 5,639,213

[45] Date of Patent: Jun. 17, 1997

[54] SWING STRUCTURE OF ELECTRIC FAN HEAD

[76] Inventor: ching-shun Chi, No. 8, Lane 280, Jennshing Road, Taichung City, Taiwan

[21] Appl. No.: 604,059

[22] Filed: Feb. 20, 1996

[51] Int. Cl.[6] ..... F01D 7/00

[52] U.S. Cl. ..... 416/100

[58] Field of Search ..... 416/100

[56] References Cited

U.S. PATENT DOCUMENTS 2,811,304 10/1957 Russer et al. ..... 416/100

3,110,829 11/1963 Sundt ..... 416/100

*Primary Examiner*—John T. Kwon

*Attorney, Agent, or Firm*—Pro-Techtor International

[57] ABSTRACT

A fan head swing mechanism comprises a swing shaft fastened with the fan head, a rotary plate, a connection rod, and a leg connection seat having a locating rod. The leg connection seat is fastened with the swing shaft. The rotary plate is driven by a motor and is provided with an eccentric shaft which is fastened with one end of the connection rod. The connection rod is provided integrally at another end thereof with a sleeve engageable with the locating rod of the leg connection seat. The sleeve is provided in the inner wall thereof with a protuberance which is movable received in a straight slot and a sectoral slot of the locating rod when the sleeve is engaged with the locating rod. The fan head is caused to swing when the motor is in operation.

3 Claims, 4 Drawing Sheets

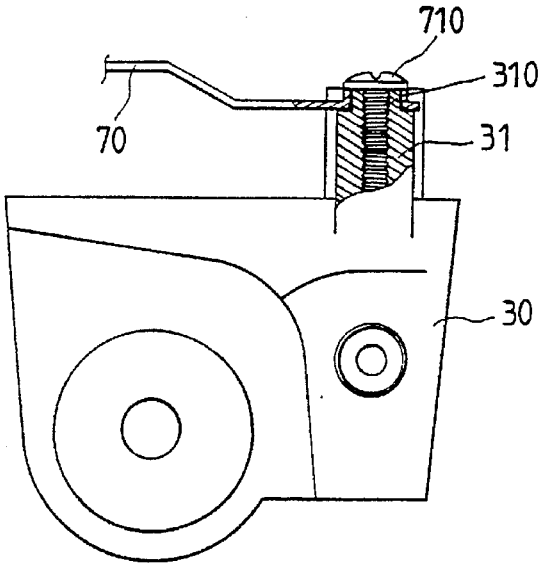
PRIOR ART
FIG, 3
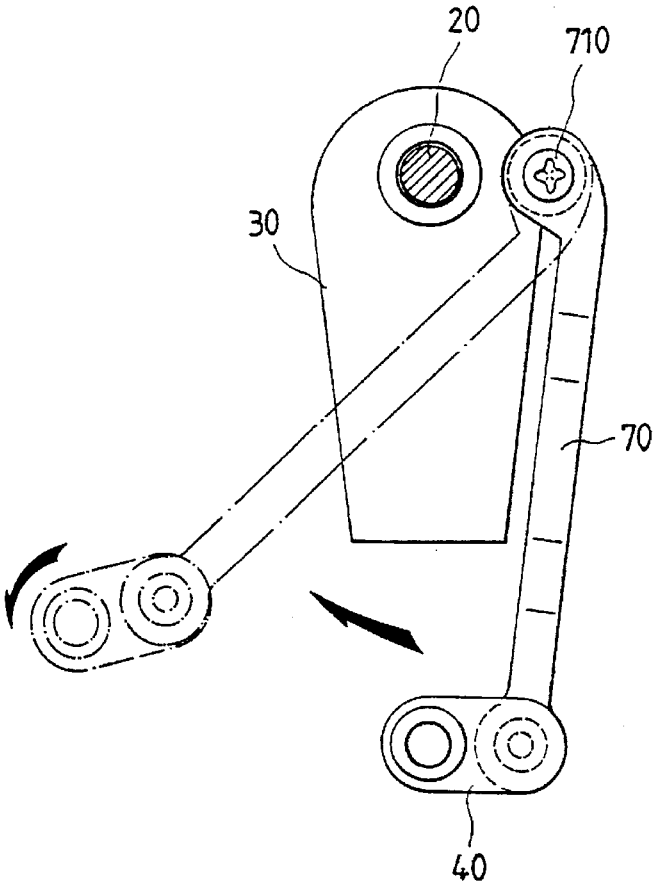
PRIOR ART
FIG, 2

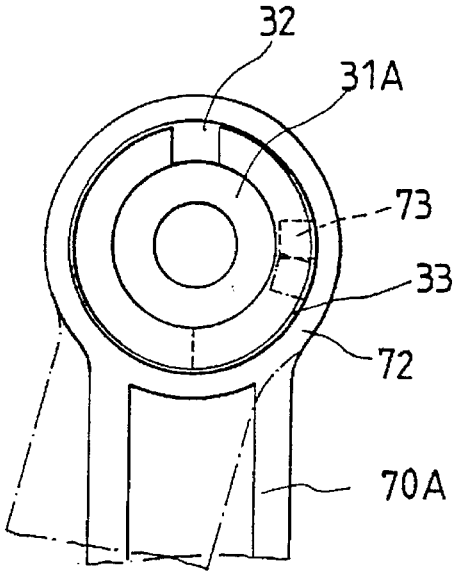
FIG, 5
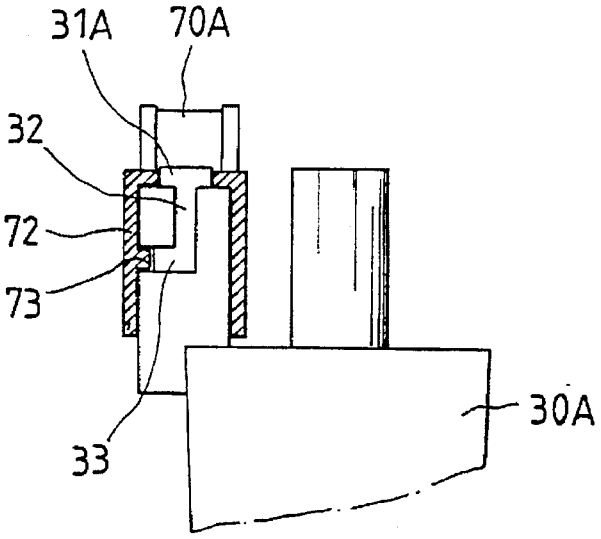
FIG, 6

SWING STRUCTURE OF ELECTRIC FAN HEAD

FIELD OF THE INVENTION

The present invention relates generally to an electric fan, and more particularly to a swing structure of the electric fan head.

BACKGROUND OF THE INVENTION

As shown in FIG. 1, a prior art electric fan head 10 is provided with a swing shaft 20 which is fastened thereto for fastening the fan head 10 with a leg connection seat 30. The swing shaft 20 serves as a swing axis. The fan bead 10 is provided at another end thereof with a rotary plate 40 driven by a deceleration device 50 which is actuated by a motor 60. The rotary plate 40 is provided at one side thereof with an eccentric shaft 41 which is fastened with a connection rod 70. The swing shaft 20 is provided with a locating rod 31 having a connection hole 310 engageable with a fastening screw 710 for fastening the locating rod 31 with a fitting hole 71 of the connection rod 70. Now referring to FIG. 2, the electric fan head 10 is caused to swing back and forth in a sectoral manner by the rotary plate 40 when the motor 60 is at work.

As illustrated in FIG. 3, the locating rod 31 of the leg connection seat 30 is fastened with the connection rod 70 by the fastening screw 710 which is received in the fitting hole 71 of the connection rod 70 and the connection hole 310 of the locating rod 31. The work of fastening the locating rod 31 with the connection rod 70 by means of the fastening screw 710 is rather time-consuming. In addition, the fastening screw 710 is vulnerable to becoming loosened by the swinging connection rod 70, thereby causing the electric fan head 10 to become incapable of swinging when the electric fan is in motion.

SUMMARY OF THE INVENTION

It is therefore the primary objective of the present invention to provide an electric fan head with a swing structure capable of overcoming the shortcomings of the prior art electric fan head described above.

BRIEF DESCRIPTION OF THE DRAWINGS

FIG. 2 is a schematic view illustrating the swinging of a connection rod of the prior art swing structure as shown in FIG. 1.

FIG. 3 is a schematic view illustrating the fastening of the connection rod with a locating rod of the prior art swing structure as shown in FIG. 1.

FIG. 5 is a schematic view illustrating the fastening of a connection rod with a locating rod of the electric fan head swing structure of the present invention.

FIG. 6 is a sectional view illustrating the fastening of the connection rod with the locating rod of the electric fan head swing structure of the present invention.

DETAILED DESCRIPTION OF THE EMBODIMENT

Figure 1:
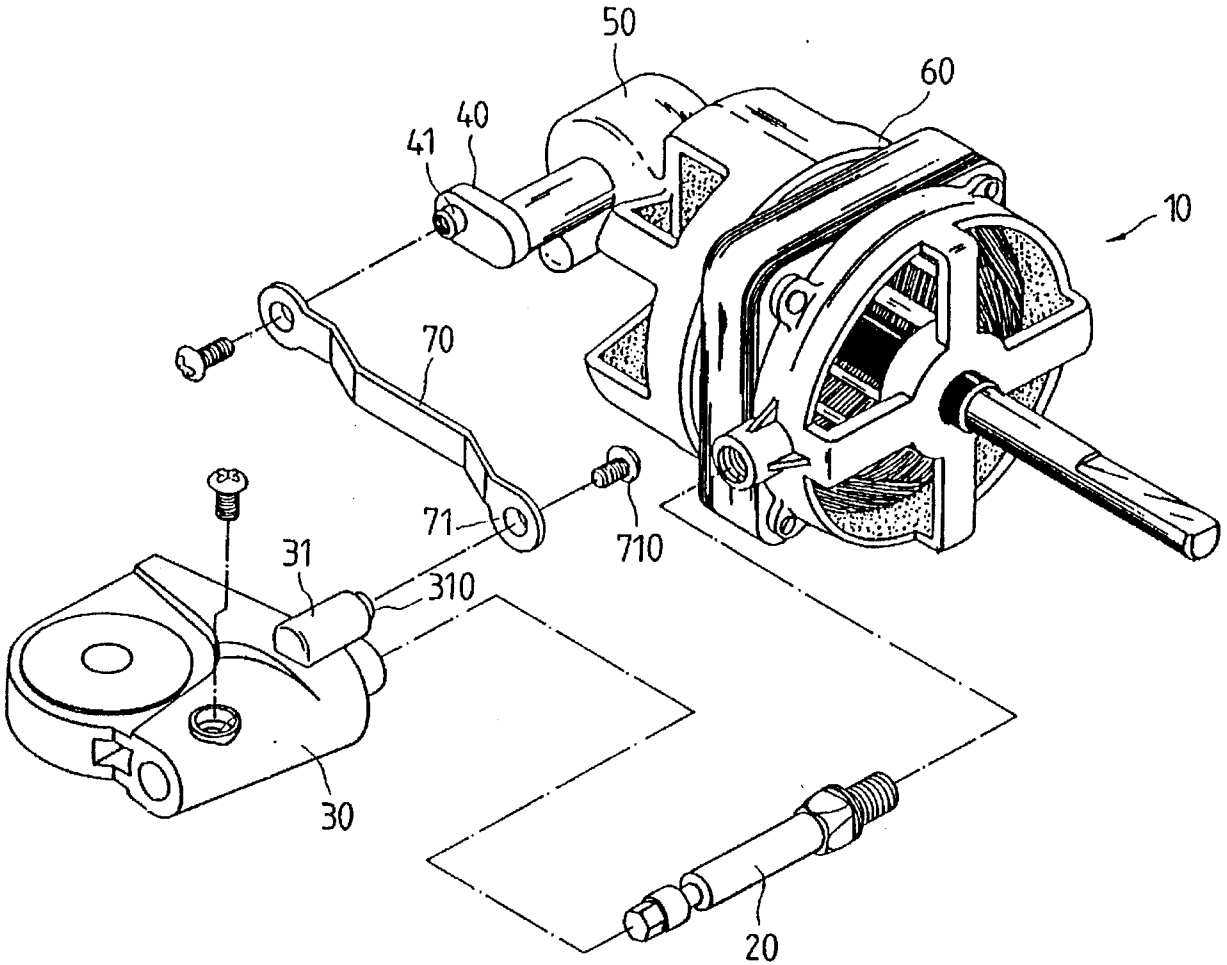
PRIOR ART FIG. 1
FIG. 1 shows an exploded view of a prior art swing structure of the electric fan head.
Figure 4:
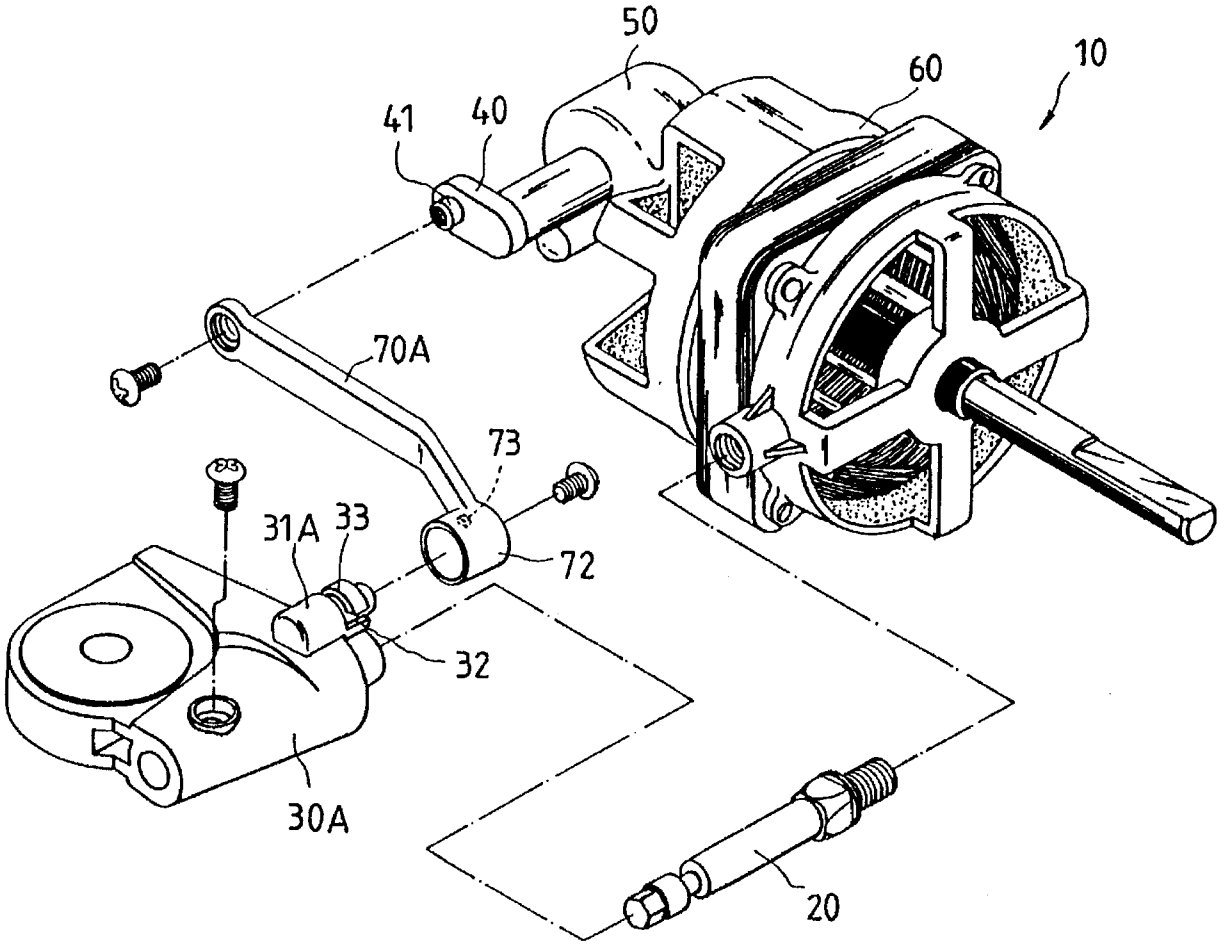
FIG. 4 shows an exploded view of an electric fan head swing structure of the present invention.

As shown in FIG. 4, an electric fan head swing structure embodied in the present invention comprises a swing shaft

20 which is fastened with an electric fan head 10 and a leg connection seat 30A for serving as a swing axis. The electric fan head 10 is provided at another end thereof with a rotary plate 40 which is driven by a motor 60 via a deceleration device 50. The rotary plate 40 is provided with art eccentric shaft 41 fastened thereto. A connection rod 70A is fastened at one end thereof with the eccentric shaft 41. The leg connection seat 30A comprises a locating rod 31A, which is fastened with another end of the connection rod 70A. The rotary plate 40 is actuated by the motor 60 to cause the electric fan head 10 to swivel when the electric fan is in operation.

The features of the present invention are described explicitly hereinafter.

The connection rod 70A is provided with a sleeve 72 which is made integrally with the connection rod 70A and is opposite in location to the locating rod 31A. The sleeve 72 is provided in the inner wall thereof with a protuberance 73.

The locating rod 31A of the leg connection seat 30A is provided in the outer wall surface thereof with a straight slot 32 of a predetermined length and extending in the direction of the longitudinal axis of the locating rod 31A. The locating rod 31A is further provided in the outer surface thereof with a sectoral slot 33 extending in the direction of the radius of the locating rod 31A such that the sectoral slot 33 intersects the straight slot 32 and that the sectoral slot 33 is perpendicular to the straight slot 32. The sectoral slot 33 has a range which is greater than the range of the swing angle of the connection rod 70A.

In combination, the connection rod 70A is fastened with the locating rod 31A such that the sleeve 72 is fitted over the locating rod 31A and that the protuberance 73 of the sleeve 72 is received in the straight slot 32 of the locating rod 31A and further that the protuberance 73 of the sleeve 72 can be caused to move into the sectoral slot 33 of the locating rod 31A when the connection rod 70A is caused to swing, as illustrated in FIGS. 4 and 5. The sleeve 72 of the connection rod 70A is engaged securely with the locating rod 31A in view of the fact that the sectoral slot 33 of the locating rod 31A is greater in range than the swing angle of the connection rod 70A, and that the protuberance 73 of the sleeve 72 of the connection rod 70A is movably retained in the sectoral slot 33 of the locating rod 31A when the connection rod 70A is caused to swing. It is therefore readily apparent that the present invention is different from the prior art in that the former is devoid of the fastening screw fly which the connection rod and the locating rod of the prior art are fastened with each other, and that the connection rod and the locating rod of the former are so securely engaged with each other without the use of the fastening screw so as to avert the incident of the disengagement of the connection rod with the locating rod.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A fan head swing mechanism comprising:

a swing shaft fastened to a fan head, a rotary plate fastened to said fan head so that said rotary plate is driven by a motor via a deceleration device, said rotary plate has an eccentric shaft connected to a first end of a connection rod, and a second end of said connection rod is connected to a leg connection seat, said leg connection seat includes a locating rod connected to a first end of a connection rod, a second end of said connection rod is connected to said fan head, said connection rod includes a sleeve fastened thereto such that said sleeve is engageable with said locating rod, an inner surface of said sleeve includes a protuberance, an outer surface of said locating rod includes a straight slot along a longitudinal axis of said locating rod, said locating rod further includes in said outer surface an arced slot perpendicular to an intersecting with said straight slot, said connection rod is fastened to said locating rod such that said sleeve of said connection rods fits over said locating rod, and said protuberance of said sleeve is received in said straight slot of said locating rod, said protuberance being further movably retained in said sectoral slot of said locating rod, such that when said motor is activated, said rotary plate causes said connection rod to rotate, thereby causing said protuberance to move within said arced slot of said locating rod, thereby driving said swing shaft via said leg connection seat, such that said fan head is made to swivel.

2. The fan head swing mechanism as claimed in claim 1 wherein:

said sleeve is integral to said connection rod.

3. The fan head swing mechanism as claimed in claim 1 wherein:

said arced slot of said locating rod is larger that a swing angle of said connection rod.

* * * * *